US005797192A

United States Patent [19]

Curtis

[11] Patent Number: 5,797,192

[45] Date of Patent: Aug. 25, 1998

[54] METHOD AND APPARATUS FOR A RUG CUTTING GUIDE

[76] Inventor: Michael Curtis, 916 N. Henrietta St., Henrietta, Tex. 76365

[21] Appl. No.: 680,128

[22] Filed: Jul. 3, 1996

[51] Int. Cl.[6] ..... B26D 7/01; B43L 7/00

[52] U.S. Cl. ..... 33/526; 33/474; 33/481; 33/42; 33/562; 7/103; 30/289

[58] Field of Search ..... 33/526, 527, 474, 33/481, 626, 628, 42, 562, 566; 7/103; 30/286, 288, 289, 290, 291, 282

[56] References Cited

U.S. PATENT DOCUMENTS

| | | | |
|---|---|---|---|
| 1,135,259 | 4/1915 | Cokely | 33/481 |
| 2,000,773 | 5/1935 | McGlauflin | 33/474 |
| 3,678,586 | 7/1972 | Weber | 33/527 |
| 3,772,793 | 11/1973 | Anderson et al. | 33/527 |
| 4,143,463 | 3/1979 | Trankle | 33/527 |
| 4,349,966 | 9/1982 | Marino et al. | 33/489 |
| 4,429,461 | 2/1984 | Glavic | 30/289 |
| 4,505,039 | 3/1985 | Donovan | 33/527 |
| 5,404,778 | 4/1995 | Ward | 30/289 |

FOREIGN PATENT DOCUMENTS

| | | | |
|---|---|---|---|
| 191166 | 8/1957 | Austria | 33/474 |
| 2244915 | 12/1991 | United Kingdom | 7/103 |

*Primary Examiner*—Christopher W. Fulton
*Attorney, Agent, or Firm*—Hazel & Thomas

[57] ABSTRACT

A guide device for securing carpet to a floor incorporates an elongated main body having an aligning edge portion for positionally aligning with a Z-bar secured to a floor to be carpeted, and an elongated vertical edge element operatively secured to a top surface of the main body and extending parallel to a longitudinal axis of the main body. The vertical edge element is positioned a predetermined distance from the aligning edge portion along an entire length of the main body. In operation, the aligning edge portion of the guide device is positionally aligned with a bend portion of a Z-bar secured to a floor to be carpeted. A carpet to be secured with the Z-bar is laid on top of the Z-bar and the guide device. The carpet is then cut along the vertical edge element of the guide device, wherein a remaining portion of the carpet extends approximately the predetermined distance beyond the bend portion of the Z-bar. Finally, the remaining portion of the carpet is secured underneath the Z-bar.

4 Claims, 3 Drawing Sheets

METHOD AND APPARATUS FOR A RUG CUTTING GUIDE

BACKGROUND OF THE INVENTION

1. Field of the Invention

The present invention relates to an apparatus for trimming and installing carpeting. In particular, the apparatus is used for measuring, aligning and trimming the edge of a carpet to be mounted on the floor using a Z-bar.

2. Description of the Prior Art

Currently, a person installing a carpet may be faced with a job site wherein different rooms are to be covered using different floor materials. For example, a dining room will be designated to be covered with wall-to-wall carpeting, while an adjoining kitchen will be designated to be covered with hardwood, marble or linoleum.

In such situations, the person installing the carpet must affix the edge of the carpet in the dining room at a transition point to the kitchen. That point of transition may be a simple doorway or a line designated on the floor that signifies the change from one room (i.e., the dining room) to another (i.e., the kitchen).

In mounting the carpet at such transition points, carpet is typically mounted to the floor using what is known as Z-bar 100 as illustrated in FIGS. 3A–3D in cross-section. The Z-bar is an elongated strip of metal, typically aluminum, that is generally Z-shaped in cross-section as shown in FIG. 3A. One longitudinal edge side 101 of the Z-bar is fixedly mounted onto the floor along the transition point, and positioned toward the room with the carpeting. The Z-bar is mounted using conventional fastening devices such as a tack strip 103. The opposing longitudinal edge side 102 of the Z-bar is slightly elevated above the surface of the floor via a bending portion 104, and directed away from the room with the carpeting.

When mounting the carpet with the Z-bar, the outer edge 201 of the carpet 200 must be cut, using a conventional cutting device 300, to a dimension that would fit underneath the opposite edge side 102 of the Z-bar 100 (FIG. 3B), wherein the outer edge 201' of the carpet 200 is folded around and under the opposing edge side 102. Once the edge of the carpet is fed underneath the opposing edge side 102 of the Z-bar 100, the person installing the carpet can then pound or hammer down the opposing edge side 102 to hold the carpet in place. Typically, the person installing the carpet would use a mallot to pound and thereby bend down the Z-bar into position.

Currently, when a person installing a carpet has to align and cut the outer edge 201 of the carpet 200 to fit under the Z-bar, that person has to visually estimate where to cut the carpet. This very often results in the carpet either being cut too short or too long. This results in either there being too little carpet to fit under the Z-bar and thus failing to be properly secured in place (FIG. 3C), or there being so much excess carpet that the carpet as a whole cannot lie flat on the floor (FIG. 3D). Applicant has found that only through experience and repeated performance of the task does one normally developed skills to properly install the carpet underneath a Z-bar.

Therefore, there exists a need for a system whereby the edge of a carpet to be installed under a Z-bar can be quickly and efficiently aligned, measured, cut and installed under a Z-bar.

SUMMARY OF THE INVENTION

A general object of the present invention is to provide a system for aligning, measuring, cutting and mounting the edge of a carpet at transition points on the floor.

A further object of the present invention is to provide an apparatus or a guide that facilitates the measuring and aligning the edge of a carpet at a transition point on the floor, whereby the carpet may be easily and accurately cut for final mounting.

In a first aspect, the present invention is directed to a guide device for securing carpet to a floor that incorporates an elongated main body having an aligning edge portion for positionally aligning with a Z-bar secured to a floor to be carpeted, and an elongated vertical edge element operatively secured to a top surface of the main body and extending parallel to a longitudinal axis of the main body. The vertical edge element is positioned a predetermined distance from the aligning edge portion along an entire length of the main body.

In a second aspect, the present invention is directed to a method for accurately measuring and cutting an edge portion of a carpet to be secured to a floor via a Z-bar. The method incorporates the steps of providing a guide device having an elongated main body having an aligning edge portion, and an elongated vertical edge element operatively secured to a top surface of the main body and extending parallel to a longitudinal axis of the main body, positionally aligning the aligning edge portion of the guide device with a bend portion of a Z-bar secured to a floor to be carpeted, laying a carpet to be secured with the Z-bar on top of the Z-bar and the guide device, cutting the carpet along the vertical edge element of the guide device, wherein a remaining portion of the carpet extends approximately the predetermined distance beyond the bend portion of the Z-bar and securing the remaining portion of the carpet underneath the Z-bar. The step of providing the guide device includes positioning the vertical edge element a predetermined distance from the aligning edge portion along an entire length of the main body.

These and other objects and features of the present invention will be apparent from the following Detailed Description of the Preferred Embodiments.

BRIEF DESCRIPTION OF THE DRAWINGS

The invention will be further described in conjunction with the accompanying drawings, in which.

DETAILED DESCRIPTION OF THE PREFERRED EMBODIMENT

Figure 1:
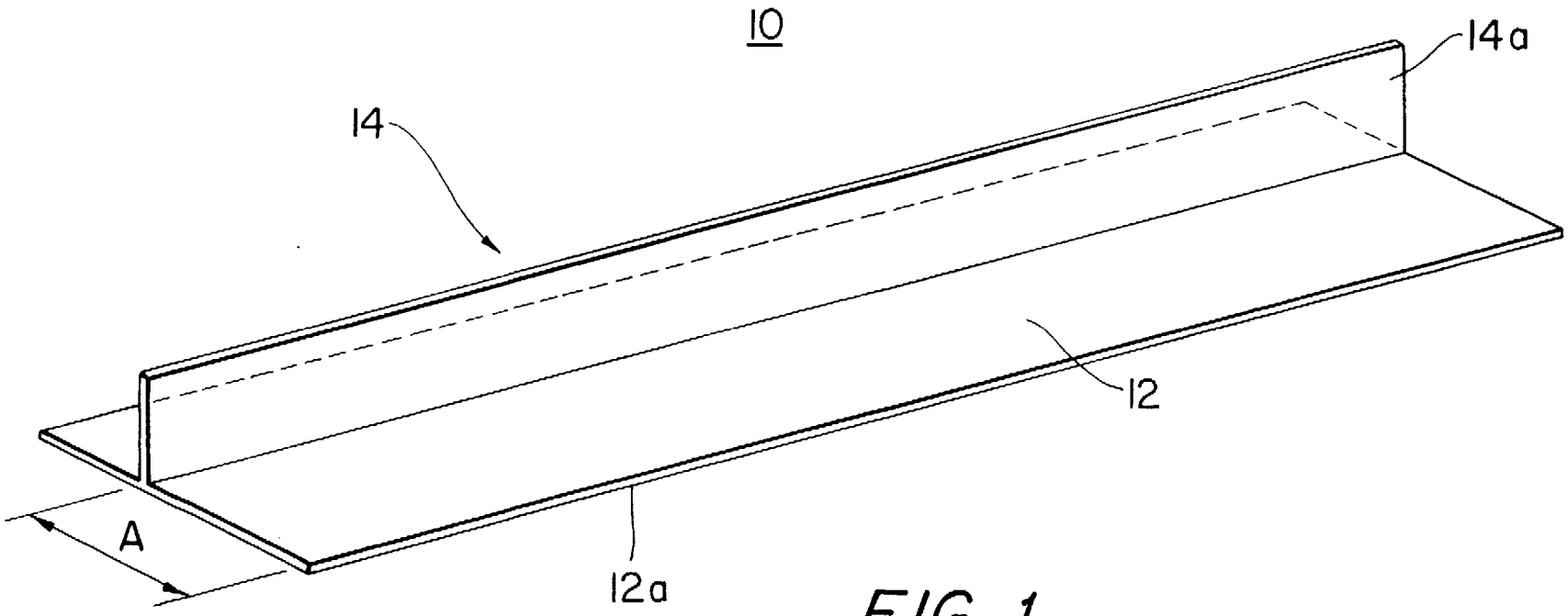
FIG. 1 illustrates a general embodiment of the apparatus of the present invention.

With reference to the figures, like reference characters will be used to indicate like elements throughout the several embodiments and views thereof. In particular, with reference to FIG. 1, the apparatus of the present invention is embodied in a guide 10 that includes a main body 12 and a vertical edge 14. The main body 12 constitutes an elongated body that includes an aligning edge portion **12*a***.

The aligning edge portion **12*a* is formed so as to abut against the bend portion 104 of a Z-bar 100 that is already secured to the floor. The vertical edge 14 is an elongated strip 14*a* fixedly positioned on a top surface of the main body 12 and parallel to the longitudinal axis of the main body. The elongated strip 14*a* is formed such that the outer edge 201 of a carpet 200 to be mounted may be aligned with the vertical edge 14, and the carpet 200 can be cut along the vertical edge 14**.

The aligning edge portion 12*a* and the elongated strip 14*a* are positioned a distance A relative to each other. The distance A is selected in order to have a specified amount of the outer edge 201 of the carpet remain after the carpet is cut along the vertical edge 14. That specified amount of remaining carpet is then capable of being folded under the opposing edge 102 of the Z-bar 100 and being held in place without either leaving too much carpet that the carpet 200 as a whole cannot lie flat or too little carpet that the carpet cannot be held securely by the Z-bar 100. For example, for a standard Z-bar, the distance A is set at 1.50 inches.

In this first embodiment, the guide 10 is formed using metal such as 16 or 18 gauge sheet metal but may be formed using a strong plastic material as well. Further, the guide 10 is formed with a length of 24 inches but may be of any length to accommodate the particular job, user or material used to construct the guide 10.

Figure 2A:
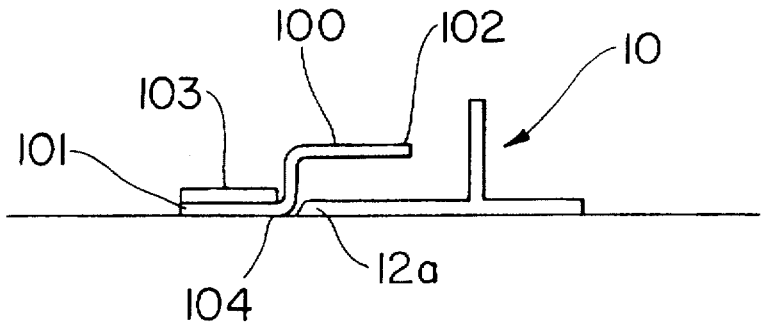
FIGS. 2A through 2D show the steps in using the apparatus of the present invention in cross-section.
Figure 2B:
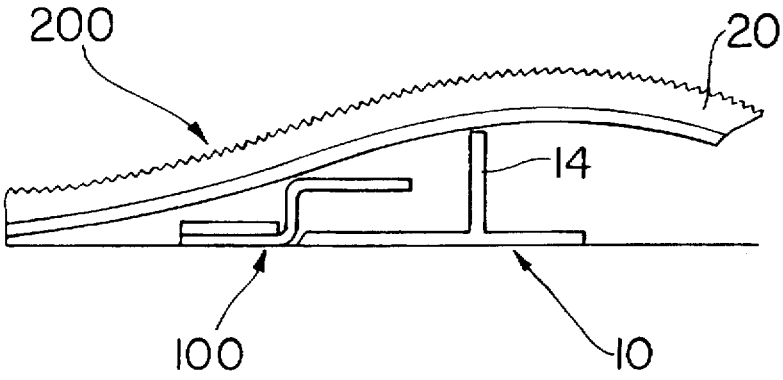
Figure 2C:
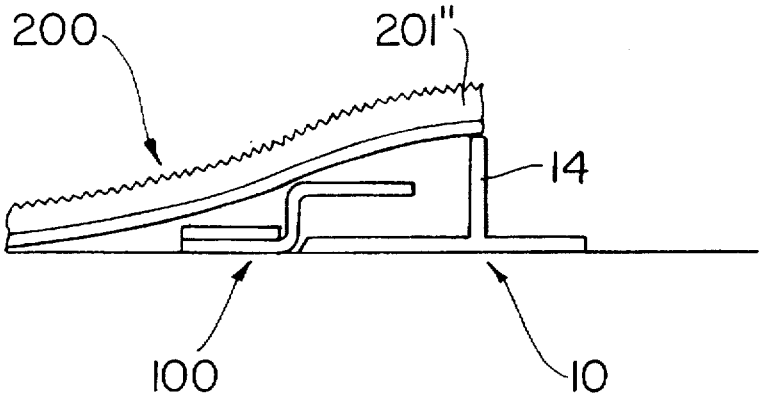
Figure 2D:
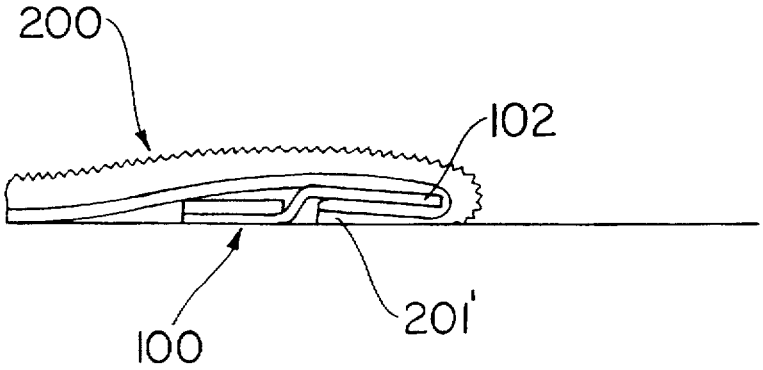
Figure 3A:
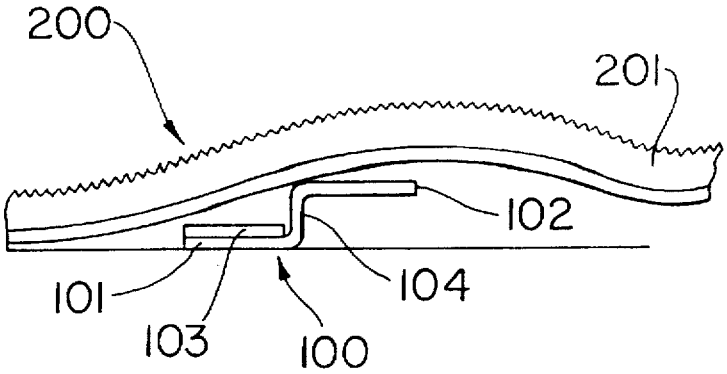
FIGS. 3A–3D illustrate in cross-section the general steps for final mounting of a carpet under a Z-bar as done in the prior art.
Figure 3B:
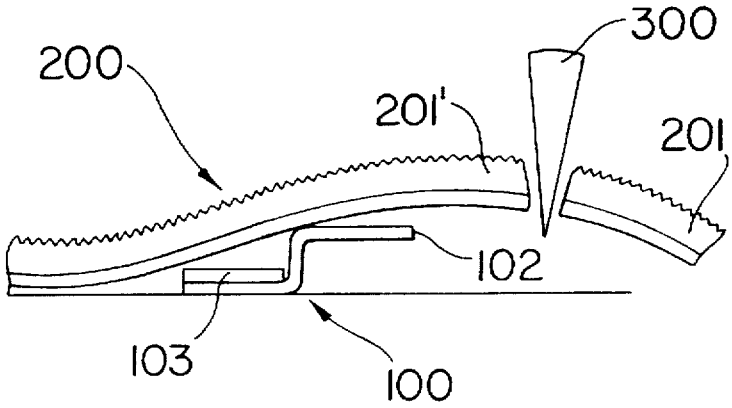
Figure 3C:
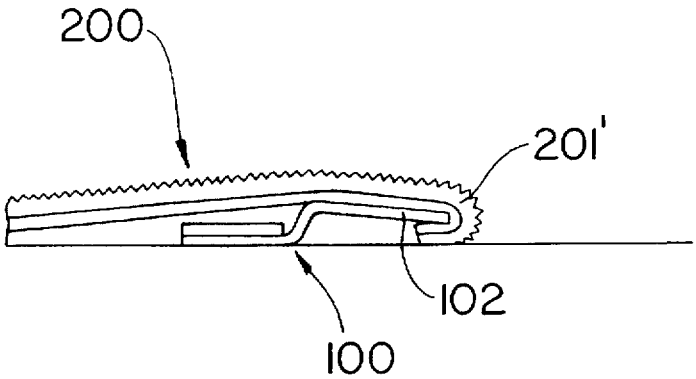
Figure 3D:
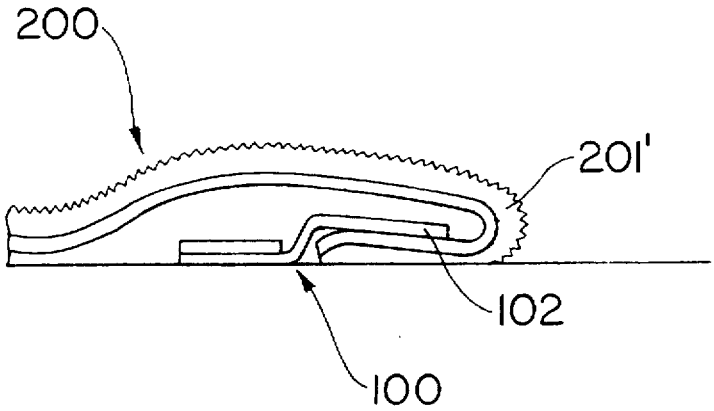

In operation, as shown in FIGS. 2A–2D, the guide 10 is first positioned with a Z-bar 100 that is secured to the floor whereby the aligning edge portion 12*a* abuts along the longitudinal edge of the bend portion 103 of the Z-bar 100 (FIG. 2A). The outer edge 201 of the carpet 200 is then laid on top of the Z-bar 100 and the guide 10 (FIG. 2B). With the carpet 200 in position, the vertical edge 14 acts as a guide for cutting the carpet accordingly. In other words, any portion of the carpet that overhangs beyond the vertical edge 14 is cut using a device for cutting carpet as known in the art, such as a carpet knife (FIG. 2C). Lastly, the guide 10 is removed and the remaining edge 201" of the carpet 200 that aligned with the vertical edge 14 of the guide 10 is folded underneath the opposing edge 102 of the Z-bar 100 and secured in place. By using the guide 10 to determine where to cut the carpet 200, the proper amount of carpet may be consistently formed to secure the carpet underneath the Z-bar without causing the carpet 200 as a whole to bulge unnecessarily or to not be fully secured by the Z-bar 100.

Although the present invention has been fully described in connection with the preferred embodiment thereof with reference to the accompanying drawings, it is to be noted that various changes and modifications will be apparent to those skilled in the art. For example, the vertical edge 14 may be formed using elongated elements that in cross-section are right triangle, square, rectangular, trapezoidal or even parallelogram in shape. The vertical edge 14 may be variably connected to the main body 12 in a manner known in the art so as to make the distance A adjustable. The guide 10 may also be formed so as to make the length of the guide 10 adjustable. These and other changes and modifications are to be understood as included within the scope of the present invention as defined by the appended claims, unless they depart therefrom.

What is claimed is:

1. A guide device for securing carpet to a floor, comprising:

an elongated main body having an aligning edge portion for positionally aligning with and abutting against a Z-bar secured to a floor to be carpeted; and means for guiding cutting of a carpet to be secured relative to the Z-bar, said guiding means including an elongated vertical edge element operatively secured to a top surface of said main body and extending parallel to a longitudinal axis of said main body, wherein said vertical edge element is positioned a predetermined distance from said aligning edge portion along an entire length of said main body whereby the carpet to be secured is cut with a remaining portion of the carpet extending approximately said predetermined distance to fit under the Z-bar when secured thereby.

2. A guide device according to claim 1, wherein said predetermined distance is 1.50 inches.

3. A method for accurately measuring and cutting an edge portion of a carpet to be secured to a floor via a Z-bar, comprising the steps of:

providing a guide device having an elongated main body having an aligning edge portion, and an elongated vertical edge element operatively secured to a top surface of said main body and extending parallel to a longitudinal axis of said main body, said step of providing said guide device includes positioning said vertical edge element a predetermined distance from said aligning edge portion along an entire length of said main body;

positionally aligning said aligning edge portion of said guide device with a bend portion of a Z-bar secured to a floor to be carpeted;

laying a carpet to be secured with said Z-bar on top of said Z-bar and said guide device;

cutting said carpet along said vertical edge element of said guide device, wherein a remaining portion of said carpet extends approximately said predetermined distance beyond said bend portion of said Z-bar; and securing said remaining portion of said carpet underneath said Z-bar.

4. A method according to claim 3, wherein said step of positioning said vertical edge element a predetermined distance from said aligning edge portion includes positioning said vertical edge element 1.50 inches from said aligning edge portion along an entire length of said main body.

* * * * *